US009771137B1

(12) United States Patent
Gable et al.

(10) Patent No.: US 9,771,137 B1
(45) Date of Patent: Sep. 26, 2017

(54) METHODS AND SYSTEMS FOR CONTROLLING STEERING LOADS ON A MARINE PROPULSION SYSTEM

(71) Applicant: Brunswick Corporation, Lake Forest, IL (US)

(72) Inventors: Kenneth G. Gable, Oshkosh, WI (US); Brad E. Taylor, Dallas, TX (US); Steven J. Andrasko, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 14/960,551

(22) Filed: Dec. 7, 2015

(51) Int. Cl.
*B63H 20/12* (2006.01)
*B63H 20/00* (2006.01)
*G05D 1/02* (2006.01)

(52) U.S. Cl.
CPC ..... *B63H 20/12* (2013.01); *G05D 1/0206* (2013.01); *B63H 2020/003* (2013.01)

(58) Field of Classification Search
CPC . B63H 20/12; B63H 2020/003; G05D 1/0206
USPC ..... 701/21
See application file for complete search history.

(56) References Cited

U.S. PATENT DOCUMENTS 6,402,577 B1 6/2002 Treinen et al.
6,821,168 B1 11/2004 Fisher et al.
7,150,664 B1 12/2006 Uppgard et al.
7,255,616 B1 8/2007 Caldwell
7,467,595 B1 12/2008 Lanyi et al.
7,527,538 B2 5/2009 Mizutani
8,046,122 B1 * 10/2011 Barta ..... B63H 25/30 60/382
8,512,085 B1 8/2013 Kobilic
2010/0191397 A1 * 7/2010 Nose ..... B63H 25/42 701/21

OTHER PUBLICATIONS

Unpublished U.S. Appl. No. 14/177,762, filed Feb. 11, 2014.
Unpublished U.S. Appl. No. 14/843,439, filed Sep. 2, 2015.

* cited by examiner

*Primary Examiner* — Yazan Soofi
(74) *Attorney, Agent, or Firm* — Andrus Intellectual Property Law, LLP

(57) ABSTRACT

A method of controlling steering loads on a marine propulsion system of a marine vessel is provided. The marine vessel has at least two sets of marine drives, each set having at least an inner marine drive and an outer marine drive, and a steer-by-wire steering actuator is associated with each set of marine drives. The method includes determining a maximum required actuator pressure on each steer-by-wire steering actuator, and determining a pressure reduction amount based on the maximum required actuator pressure. A link toe angle has been determined based on the pressure reduction amount. A mechanical link connecting each inner marine drive to the respective outer marine drive is adjusted to achieve the link toe angle.

20 Claims, 6 Drawing Sheets

METHODS AND SYSTEMS FOR CONTROLLING STEERING LOADS ON A MARINE PROPULSION SYSTEM

FIELD

The present disclosure relates to methods and systems for controlling steering loads on steering actuators in a marine propulsion system. More specifically, the present disclosure relates to methods and systems utilizing tie bars and steering actuators to provide a toe angle between two or more sets of at least two marine propulsion devices.

BACKGROUND

The following U.S. patents and patent applications are hereby incorporated herein by reference.

U.S. Pat. No. 6,821,168 discloses an outboard motor provided with an internally contained cylinder and moveable piston. The piston is caused to move by changes in differential pressure between first and second cavities within the cylinder. The hydraulic steering system described in U.S. Pat. No. 6,402,577 is converted to a power hydraulic steering system by adding a hydraulic pump and a steering valve to a manual hydraulic steering system.

U.S. Pat. No. 7,150,664 discloses a steering actuator system for an outboard motor that connects an actuator member to guide rails, which are, in turn, attached to a motive member such as a hydraulic cylinder. The hydraulic cylinder moves along a first axis with the guide rail extending in a direction perpendicular to the first axis. An actuator member is movable along the guide rail in a direction parallel to a second axis and perpendicular to the first axis. The actuator member is attached to a steering arm of the outboard motor.

U.S. Pat. No. 7,255,616 discloses a steering system for a marine propulsion device that eliminates the need for two support pins and provides a hydraulic cylinder with a protuberance and an opening which cooperate with each other to allow a hydraulic cylinder's system to be supported by a single pin for rotation about a pivot axis. The single pin allows the hydraulic cylinder to be supported by an inner transom plate in a manner that it allows it to rotate in conformance with movement of a steering arm of a marine propulsion device.

U.S. Pat. No. 7,467,595 discloses a method for controlling the movement of a marine vessel including rotating one of a pair of marine propulsion devices and controlling the thrust magnitudes of two marine propulsion devices. A joystick is provided to allow the operator of the marine vessel to select port-starboard, forward-reverse, and rotational direction commands that are interpreted by a controller which then changes the angular position of at least one of a pair of marine propulsion devices relative to its steering axis.

U.S. Pat. No. 8,046,122 discloses a control system for a hydraulic steering cylinder utilizing a supply valve and a drain valve. The supply valve is configured to supply pressurized hydraulic fluid from a pump to either of two cavities defined by the position of a piston within the hydraulic cylinder. A drain valve is configured to control the flow of hydraulic fluid away from the cavities within the hydraulic cylinder. The supply valve and the drain valve are both proportional valves in a preferred embodiment of the disclosed invention in order to allow accurate and controlled movement of a steering device in response to movement of a steering wheel of a marine vessel.

U.S. Pat. No. 8,512,085 discloses a tie bar apparatus for a marine vessel having at least first and second marine drives. The tie bar apparatus comprises a linkage that is geometrically configured to connect the first and second marine drives together so that during turning movements of the marine vessel, the first and second marine drives steer about respective first and second vertical steering axes at different angles, respectively.

U.S. patent application Ser. No. 14/177,762, filed Feb. 11, 2014, discloses a system for controlling movement of a plurality of drive units on a marine vessel having a control circuit communicatively connected to each drive unit. When the marine vessel is turning, the control circuit defines one of the drive units as an inner drive unit and another of the drive units as an outer drive unit. The control circuit calculates an inner drive unit steering angle and an outer drive unit steering angle and sends control signals to actuate the inner and outer drive units to the inner and outer drive unit steering angles, respectively, so as to cause each of the inner and outer drive units to incur substantially the same hydrodynamic load while the marine vessel is turning. An absolute value of the outer drive unit steering angle is less than an absolute value of the inner drive unit steering angle.

U.S. Pat. No. 7,527,538 discloses a small boat has multiple propulsion units. A toe angle of the multiple propulsion units can be altered while the boat is under way. The toe angle can be adjusted to improve performance in any of a number of areas, including top speed, acceleration, fuel economy, and maneuverability, at the demand of the operator.

U.S. patent application Ser. No. 14/843,439, filed Sep. 2, 2015 discloses systems and methods for reducing steering pressures of marine propulsion device steering actuators are disclosed. First and second sensors sense first and second conditions of first and second steering actuators. A third sensor senses an operating characteristic of the marine vessel. A controller is in signal communication with the first, second, and third sensors. In response to the marine vessel travelling generally straight ahead, the controller determines a target toe angle between the first and second marine propulsion devices based on the operating characteristic. The controller commands the first and second steering actuators to position the first and second marine propulsion devices at the target toe angle. The controller thereafter gradually adapts the target toe angle between the first and second marine propulsion devices until the controller determines that an absolute difference between the first condition and the second condition reaches a calibrated value.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one example of the present disclosure, a method of controlling steering loads on a marine propulsion system of a marine vessel is provided. The marine vessel has at least two sets of marine drives, each set having at least an inner marine drive and an outer marine drive, and a steer-by-wire steering actuator is associated with each set of marine drives. The method includes determining a maximum required actuator pressure on each steer-by-wire steering actuator, and determining a pressure reduction amount based on the maximum required actuator pressure. A link toe angle has been determined based on the pressure reduction amount. A mechanical link connecting each inner marine drive to the respective outer marine drive is adjusted to achieve the link toe angle. In a further embodiment, an actuator toe angle is determined based on a speed of the marine vessel, and the toe angle of each set of marine drives is adjusted with the steer-by-wire steering actuator by the actuator toe angle.

According to another example of the present disclosure, a marine propulsion system has at least two sets of marine drives, each set of marine drives having at least an inner marine drive and an outer marine drive. The system further includes an adjustable mechanical link connecting each inner marine drive to the respective outer marine drive to achieve a link toe angle. A steer-by-wire steering actuator is associated with each set of marine drives, and a steering controller is associated with each steering actuator. Each steering controller determines a an actuator toe angle based on the speed of the vessel to minimize the work of the associated steer-by-wire steering actuator and controls that steer-by-wire steering actuator to rotate the associated set of marine drives by the actuator toe angle.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed.

Figure 1:
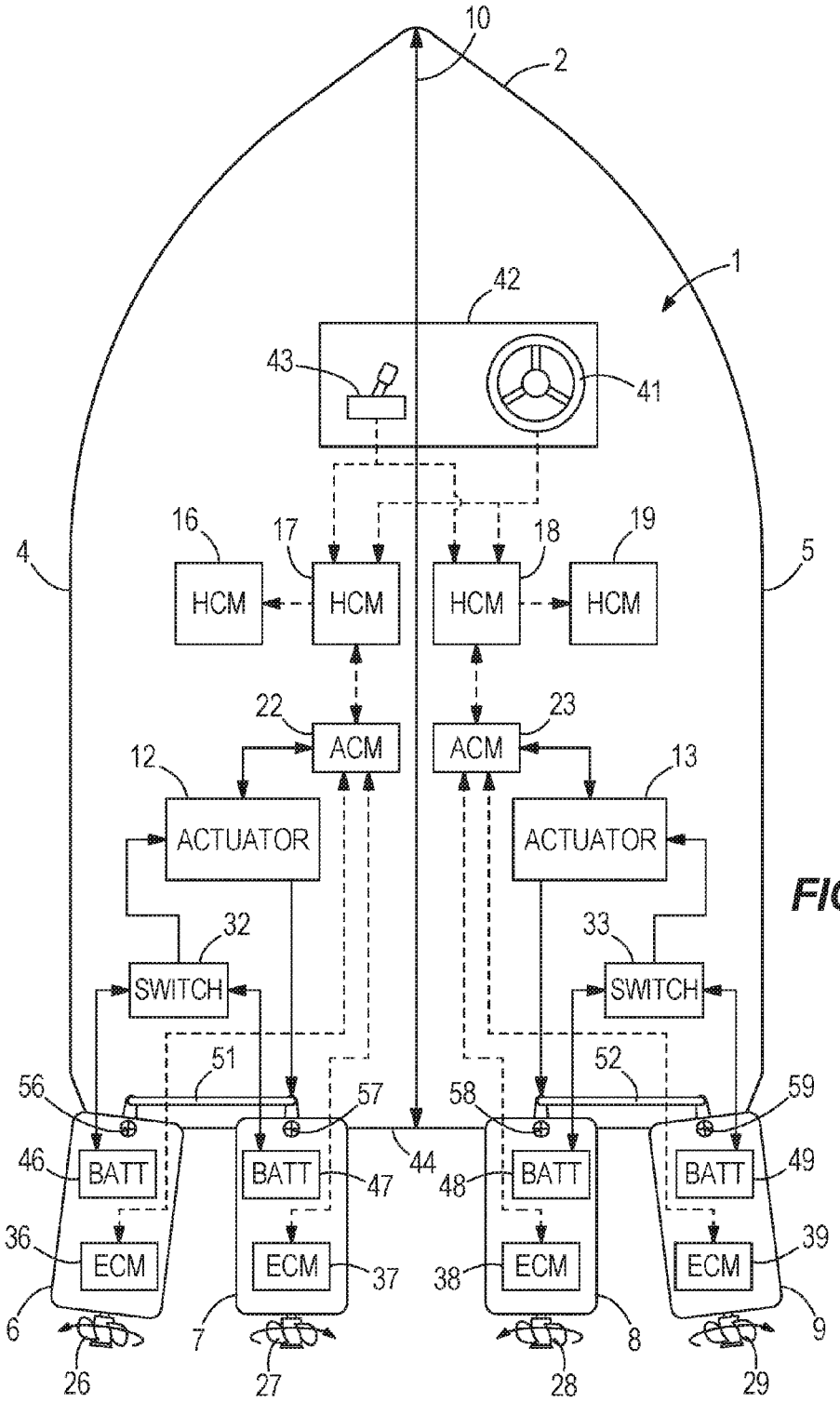
FIG. 1 illustrates one embodiment of a marine vessel having a marine propulsion system including two sets of marine drives, each set of marine drives having at least an inner marine drive and an outer marine drive.

FIG. 1 illustrates a marine vessel 2 having a marine propulsion system 1 in accordance with the present disclosure. The marine propulsion system 1 includes four marine drives 6-9, which are outboard motors coupled to the transom 44 of the marine vessel 2. The marine drives 6-9 are attached to the vessel 2 in a conventional manner such that each drive 6-9 is rotatable about a respective vertical steering axis 56-59. In the example of FIG. 1, the marine drives 6-9 are configured in two sets of two marine drives, one set on each side of the centerline 10 along the keel. Marine drives 6 and 7 comprise one set fixed to the port side 4 of the stern 3 (port of the centerline 10), and marine drives 8 and 9 comprise the second set fixed to the starboard side 5 of the stern 3. The first set of marine drives 6 and 7 include outer port drive 6 and inner port drive 7. The second set of marine drives 8 and 9 include inner starboard drive 8 and outer starboard drive 9. Other embodiments may include more than four drives, such as six or eight drives. The drives may be configured in two or more sets evenly distributed around the center line 10. For example, a marine propulsion system 1 having eight drives may be configured in two sets of four drives or four sets of two drives.

Each set of marine drives is connected together with a mechanical link 51, 52. In one example, the mechanical link is an adjustable tie bar, such as that described in U.S. Pat. No. 8,512,085; however, a person having ordinary skill in the art will understand in view of this disclosure that other mechanical link arrangements are appropriate. Mechanical link 51 connects the port inner marine drive 7 to the port outer marine drive 6. Likewise, the mechanical link 52 connects the inner starboard marine drive 8 to the outer starboard marine drive 9. The mechanical links 51, 52 maintain a set distance between the inner and outer marine drives in each set such that as one drive turns, the other drive in the set also turns in the same direction and by an equal amount. In other words, the inner marine drive and the outer marine drive of each set are steered together.

However, the sets of marine drives 6 and 7, 8 and 9 are capable of being steered separately to different angles. This allows the marine drives 6-9 to operate in many different modes, including in a joystick mode such as that described in U.S. Pat. No. 7,467,595 incorporated by reference herein above. While in joystick mode, each steer-by-wire steering actuator 12, 13 may rotate the associated set of marine drives 6 and 7, 8 and 9 independently of one another to different steering angles about their steering axes. In other modes, the two sets of drives 6 and 7, 8 and 9 may be operated simultaneously and symmetrically, with the steer-by-wire steering actuators 12 and 13 operating the respective sets of drives 6 and 7, 8 and 9 by rotating them in equal and opposite directions.

Equipping a marine vessel 2 with four drives provides increased propulsion power allowing for high speeds of travel, including upwards of 65 MPH or 90 MPH or higher, and/or for propelling heavy vessels 2. Traditionally, vessels provided with four or more drives have all four drives tied together, such as with a combination of tie bars and hydraulic hoses and actuators, so that all engines work and steer in unison. The tying of all four drives was required in prior art systems because the tie bars were needed to bear much of the pressure created by hydrodynamic forces on the drives when operating at high speeds and/or under heavy steering loads. Thus, prior art vessels with high speed capabilities could not be outfitted with joysticking capabilities because they could not offer the independent steering capabilities required.

Through their experimentation and research in the relevant field, the present inventors have recognized that it is desirable to provide a marine vessel 2 with four marine drives that can be operated in a joysticking mode. Operation in joysticking mode requires at least two drives that are steered independently of one another in order to provide sufficient flexibility and precision of propulsion forces, as described in U.S. Pat. No. 7,467,595 which is incorporated by reference above. Accordingly, operation in a joysticking mode requires a steer-by-wire system, where individual steering actuators separately control rotation of the drives, such as through hydraulic steering systems. One example of a steer-by-wire control system is provided at U.S. Pat. No. 7,941,253, which is hereby incorporated herein by reference. While in joysticking mode, each steer-by-wire steering actuator orients the associated marine drives independently of one another and to different steering angles in response to manipulation of an input device at the helm 42, such as steering wheel 41 or joystick 43.

The present inventors have also recognized that providing a high speed marine vessel with joysticking capabilities poses problems and challenges, specifically with respect to the steering system and to providing sufficient steering pressure with steer-by-wire steering actuators to steer the marine vessel 2 at high speeds. Specifically, the inventors recognized that hydrodynamic forces on the marine drives 6-9 can overwhelm steering actuators associated therewith such that the steering actuators are incapable of providing sufficient hydraulic pressure to overcome the hydrodynamic forces and rotate the marine drives in order to effectively steer at high speeds.

Hydrodynamic forces on the marine drives are caused both by the propellers of the propulsion devices themselves as they push against the water (herein after propeller pressure) and by water moving off the hull of the vessel 2 and subsequently hitting each marine drive (herein after hull displacement pressure). During operation, unbalanced propeller pressure and hull displacement pressure require very high contrasting forces to be exerted by the steering systems, and specifically the steering actuators 51, 52, in order to maintain the marine drives 6-9 at the desired steering angles. The high pressures can overwhelm the steering actuators, which may cause the marine vessel 2 to become unresponsive to steering inputs by an operator and may further cause steering diagnostic errors.

Certain hydrodynamic forces can be decreased by positioning the marine drives 6-9 at a particular toe angle. Applicant's co-pending application Ser. No. 14/177,762, filed Feb. 11, 2014, entitled "Systems and Methods for Controlling Movement of Drive Units on a Marine Vessel," which was incorporated by reference herein above, discusses how marine propulsion devices, especially one provided in a pair, triple, or quad configuration, can be steered to different steering angles from one another so as to cause each of the propulsion devices to incur substantially the same hydrodynamic load while the marine vessel is turning. The '762 application does not, however, address the situation in which the marine vessel is traveling generally straight ahead. Applicant's co-pending application Ser. No. 14/843,439, filed Sep. 2, 2015, entitled "Systems and Methods for Continuously Adapting a Toe Angle Between Marine Propulsion Devices," which was also incorporated by reference herein above, discusses a system having a pressure sensor in each steer-by-wire steering actuator that constantly monitors the pressure on the steering system and adjusts the toe angle of the drives in a closed-loop feedback control algorithm in order to minimize hydrodynamic forces on each marine drive.

However, the present inventors have recognized that simply controlling the toe angle of each drive 6-9 with an individual steering actuator does not provide sufficient pressure relief to counteract the hydrodynamic forces on marine vessels at very high speeds. Further, the inventors have recognized that such forces can be transferred to, and at least partially counteracted by, a mechanical link 51, 52 between the inner and outer drives in a set. Moreover, the inventors have recognized that the forces can be further counteracted by connecting the drives with the mechanical link at a particular toe angle, thereby reducing inefficiencies in the steering system and illuminating possible diagnostic faults due to failure of the steering actuators to achieve the required counteracting steering forces. Accordingly, the inventors developed the present system that reduces the pressure on the steer-by-wire steering actuators 12, 13 wherein the four marine drives 6-9 are divided into two sets 6 and 7, 8 and 9, and each set is connected by a mechanical link 51, 52 that connects the inner and outer marine drives at a defined toe angle. Each set of marine drives 6 and 7, 8 and 9 can then be rotated by the steering actuator to further adjust the toe position of the marine drives, such as to a greater positive toe angle.

Figures 2A, 2B, 2C:
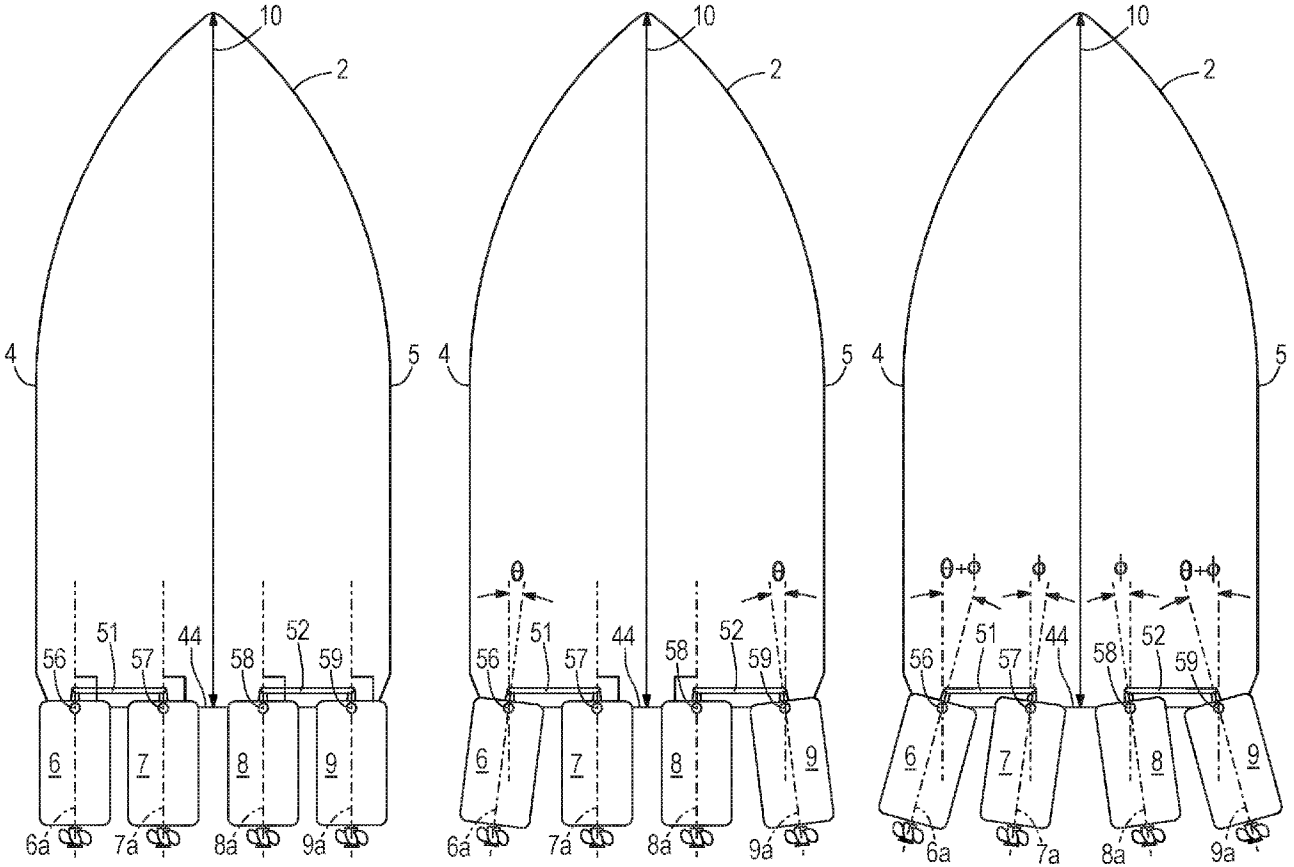
FIGS. 2A-2E illustrate examples of marine vessels containing four marine drives positioned at various toe angles.
Figure 2E:
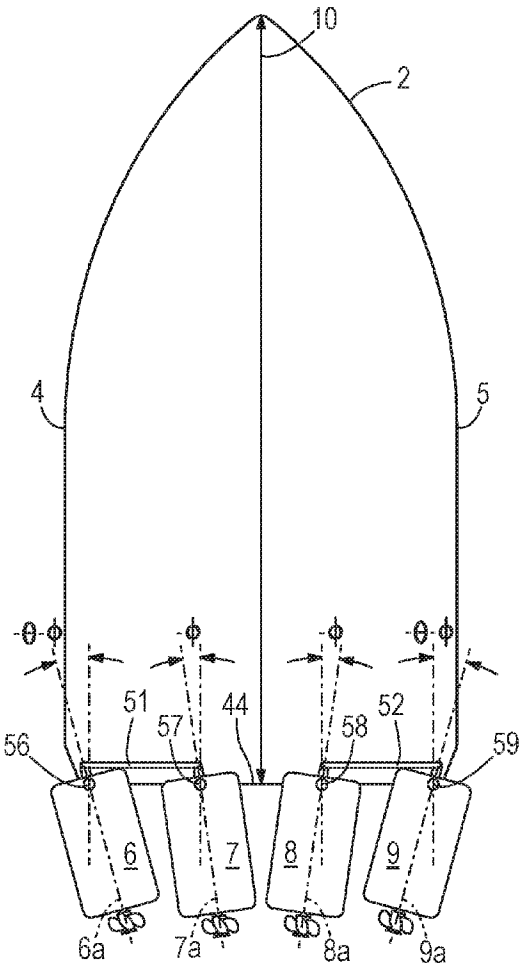
Figure 2D:
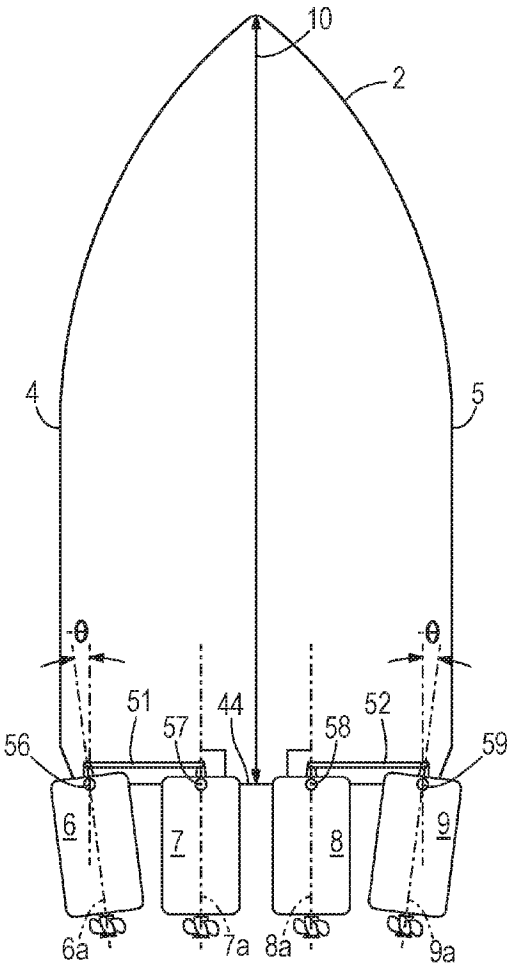

For example, referring to FIGS. 2A-2E, four marine drives 6-9 may be connected to the transom 44 of marine vessel 2, with two marine drives on either side of the center line 10 along the vessel's keel. As described above, each marine drive 6-9 is mounted to the transom 44 such that it can be rotated about a generally vertical steering axis 56-59 for each drive. FIG. 2A depicts the marine drives 6-9 oriented in a straight ahead, or neutral, position where a center line 6*a*-9*a* of each marine drive runs generally parallel to the center line 10 of the marine vessel 2. As is known to those having ordinary skill in the art, the marine drives 6-9 may be oriented in a "toe-in" orientation, wherein the marine drives 6-9 are each rotated such that their fore-most ends are turned towards the center line 10. For purposes of this disclosure, such a "toe-in" orientation will be referred to as positive toe, where the toe angle is considered to be a positive number. FIGS. 2B and 2C each depict an exemplary "toe-in" configuration of marine drives 6-9. Those having ordinary skill in the art will also know that the marine drives 6-9 can be oriented in a "toe-out" orientation in which each of their aft-most ends are rotated toward the center line 10 of the marine vessel 2. FIGS. 2D and 2E each depict an exemplary "toe-out" configuration of marine drives 6-9. For purposes of this disclosure, such a "toe-out" orientation will be referred to as negative toe, where the toe angle is expressed as a negative number. For purposes of this disclosure, toe angles are expressed as an angle degree away from the parallel position, depicted in FIGS. 2A-2C. The parallel position of the marine drive 6-9 is where the center line 6*a*-9*a* of each marine drive runs generally parallel to the center line 10 and generally perpendicular to the transom 44 of the marine vessel 2. The toe angles of the marine propulsion devices 6-8 depicted in FIGS. 2B-2E are exaggerated for purposes of illustration, and in reality the toe angles generally required by the systems and methods disclosed herein will range from about −3° to about 3° from the parallel position. Additionally, it should be understood that the marine vessel 2 is propelled in a generally straight ahead direction despite angling of the marine propulsion devices 6-9 to achieve a given toe angle. Any sideways thrust from one marine drive is cancelled by an opposing sideways thrust from a marine drive on the opposite side of the center line 10 of the marine vessel 2, resulting in additive forward thrust.

Referring again to FIG. 1, each set of marine drives 6 and 7, 8 and 9 is associated with a steer-by-wire steering actuator 12, 13. Each steer-by-wire steering actuator (hereinafter "steering actuator") 12, 13, may be any of various types of actuators, including hydraulic over electric actuators, pure electric actuators, direct driven hydraulic actuators, or any other steer-by-wire technology. Steering actuator 12 is associated with the port set of marine drives 6 and 7. Steering actuator 13 is associated with the starboard set of marine drives 8 and 9. Each actuator 12 and 13 is associated with actuator control module (ACM) 22 and 23, respectively. In one embodiment, the switches 32 and 33 operate to select the battery with the greatest charge. In the depicted embodiment, the steering actuators 12, 13 are connected to the inner drives 7, 8, and steering motion is transferred from the inner drives 7, 8 to the outer drives 6, 9 via the mechanical links 51, 52. However, the opposite configuration is also possible, where the steering actuators 12, 13 are connected to the outer drives 6, 9 and the mechanical links 51, 52 transfer steering motion to the inner drives 7, 8.

Each actuator 12, 13 is also associated with a switch 32 and 33, respectively, that selects which drive 6-9 powers the actuator 12, 13. Switch 32 alternately connects the actuator 12 to be powered by the battery 46 of inner port drive 6 or the battery 47 of outer port drive 7. Likewise, switch 33 alternately connects actuator 13 to battery 48 of inner starboard drive 8 or battery 49 of outer starboard drive 9.

Each marine drive 6-9 is controlled by a respective helm control module (HCM) 16-19. Each HCM 16-19 is communicatively connected to the engine control module (ECM) 36-39 to control the function of the respective marine drive 6-9. The dashed lines depicted in FIG. 1 demonstrate the steering control hierarchy of the depicted embodiment. Steering control inputs are provided by an operator through steering input devices, such as steering wheel 41 and/or joystick 43. Alternatively or additionally, steering outputs may be automatically provided by an autopilot system. Steering commands from the input devices go to the HCMs 17, 18 for the inner marine drives 7, 8. As the outer drives 6, 9 are connected to the inner drives 7, 8, via adjustable mechanical links 51, 52, they are not separately steerable from the inner drives. For purposes of steering, the outer drives 6,9 are "slaves" to the inner drives 7,8, and thus the HCMs 16, 19 of the outer drives 6,9 do not output steering control commands to the ACMs 22,23. Helm control module 17 processes and transmits steering commands for the port set of marine drives 6 and 7, while the HCM 18 processes and transmits steering commands for the starboard set of marine drives 8 and 9. The port HCM 17 communicates steering commands to ACM 22 for the port side actuator 12. The port HCM 17 also communicates the steering commands and/or information relevant to steering conditions to HCM 16 for the outer port drive 6. The starboard HCM 18 communicates steering commands to ACM 23 for the starboard side actuator 13. The starboard HCM 18 also communicates the steering commands and/or information relevant to steering conditions to HCM 19 for the outer starboard drive 9. The ACMs 22, 23 and the steering actuators 12, 13 then control the steering position of the respective set of marine drives 6 and 7, 8 and 9.

Each HCM 16-19, ACM 22, 23, and ECM 36-39 may include a computing system that includes a processing system, storage system, software, and input/output (I/O) interfaces for communicating with other devices, including the steering input devices at the helm 42, steering actuators 12, 13, and marine drives 6-9. The processing system loads and executes software from the storage system, including a toe angle adaptation software application module. When executed by the computing system, the toe angle adaptation software application module directs the processing system to operate as described herein below in further detail to execute the method of controlling steering loads.

The computing system may include one or many application modules and one or more processors, which may be communicatively connected. The processing system can comprise a microprocessor and other circuitry that retrieves and executes software from the storage system. Processing system can be implemented within a single processing device but can also be distributed across multiple processing devices or sub-systems that cooperate in existing program instructions. Non-limiting examples of the processing system include general purpose central processing units, applications specific processors, and logic devices.

The storage system can comprise any storage media readable by the processing system and capable of storing software. The storage system can include volatile and non-volatile, removable and non-removable media implemented in any method or technology for storage of information, such as computer readable instructions, data structures, program modules, or other data. The storage system can be implemented as a single storage device or across multiple storage devices or sub-systems. The storage system can further include additional elements, such as a controller capable of communicating with the processing system. Non-limiting examples of storage media include random access memory, read only memory, magnetic discs, optical discs, flash memory, virtual memory, and non-virtual memory, magnetic sets, magnetic tape, magnetic disc storage or other magnetic storage devices, or any other medium which can be used to store the desired information and that may be accessed by an instruction execution system. The storage media can be a non-transitory or a transitory storage media.

Besides the steering wheel 41 and the joystick 43, other user interfaces to provide steering control input could alternatively or additionally include a mouse, a keyboard, a voice input device, a touch input device (e.g., touch screen), and other comparable input devices and associated processing elements capable of receiving user input from an operator of the marine vessel 10. Output devices such as a video display or graphical display can display an interface further associated with embodiments of the system and method disclosed herein In the depicted embodiment, each set of marine drives is configured with propellers moving in counter rotating directions to one another. Specifically, the outer port drive 6 has propeller 26 rotating in a counter clockwise direction, and inner port drive 7 has propeller 27 rotating in a clockwise position. Similarly, inner starboard drive 8 has propeller 28 rotating in a counter clockwise direction, and outer starboard drive 9 has propeller 29 in a clockwise direction. Thus, the two inner drives, 7 and 8, have propellers, 27 and 28 that rotate in directions opposite from one another. Likewise, the two outer drives, 6 and 9, have propellers, 26 and 29, that rotate in directions that are opposite from one another. In another embodiment, the propellers 26-29 of each marine drive 6-9 may rotate in the opposite direction than that depicted in FIG. 1. Such a configuration keeps the same relationship between the drive rotations as described above. In yet another embodiment, each drive in the pairs could have the same rotation direction and cambered skegs could be used instead of contra-rotating propellers to reduce the load. Cambered skegs have wedges on them that provides a counter force to the propeller rotation. In a preferred embodiment, the pairs are configured with contra-rotating propellers and/or cambered skegs in ordered to reduce the steering load.

Referring to FIG. 2B, each outer marine drive 6, 9 is connected to its respective inner marine drive 7, 8 by mechanical link 51, 52 at a link toe angle θ. The link toe angle θ is a running toe angle that is not modified during operation of the marine vessel 2, as the mechanical link 51, 52 is not easily adjusted during operation of the marine vessel 2 in the water. For example, the link toe angle θ is generally determined and configured upon installation or setup of the marine drives 6-9 on the marine vessel 2. The link toe angle θ is calculated to relieve some of the pressure on the steering actuators 51, 52. In one embodiment, the link toe angle θ is calculated based on a pressure reduction amount required on the steering systems at the maximum operating pressure.

Figure 3A:
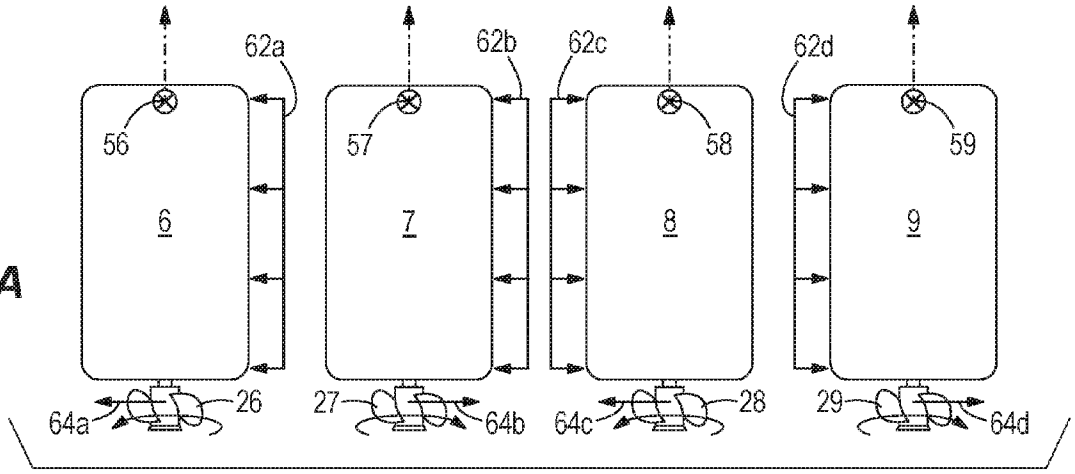
FIGS. 3A and 3B diagrammatically depict forces on four marine drives in a marine propulsion system.
Figure 3B:
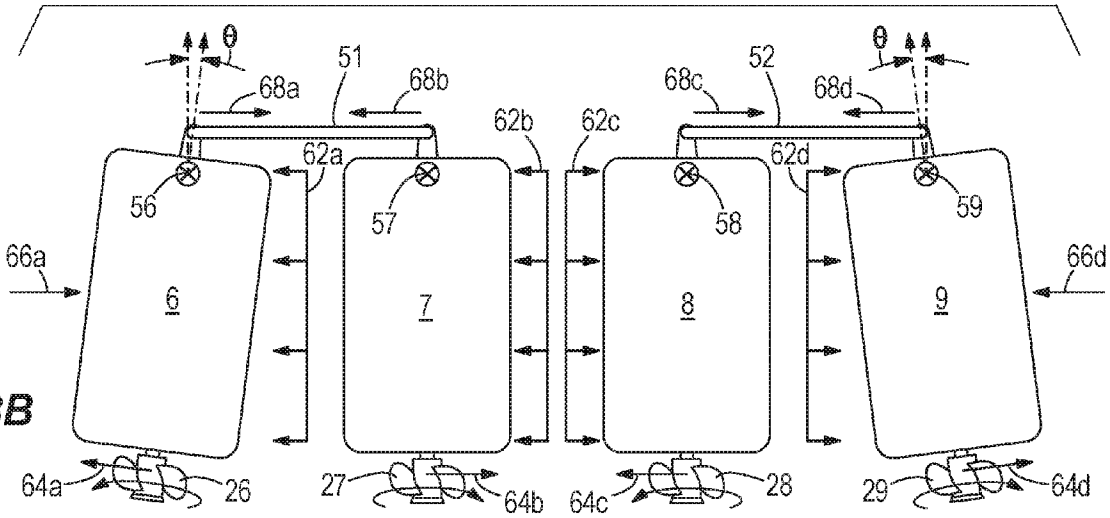

As is described above, the marine drives 6-9 experience pressure from hydrodynamic forces, including from hull displacement pressure and from propeller pressure. Hull displacement pressure 62 and propeller pressure 64 act on each marine drive 6-9. It should be understood that the hull displacement pressure 62 and the propeller pressure 64 vary with the speed of the vessel and speed of the propeller. The hull displacement and the propeller pressure at any particular speed can be added together using standard techniques of adding forces to determine the pressure on each marine drive 6-9 at that speed. FIGS. 3A and 3B provide force diagrams schematically depicting these forces on the marine drives 6-9, which will vary in magnitude with the speed of the marine vessel 2. FIG. 3A depicts all of the marine drives 6-9 in the parallel position. FIG. 3B depicts the drive sets 6 and 7, 8 and 9 connected together by mechanical links 51, 52, with the outer drives 6, 9 in a positive toe position at angle θ and the inner drives 7,8 in the parallel position. FIG. 2D shows a similar configuration, except that the outer drives 6 and 9 are configured to have negative toe, and thus are at link toe angle −θ.

On the port set of drives 6 and 7, hull displacement pressure 62*a* and 62*b*, respectively, provide force generally outward in the port direction. For the starboard set of marine drives 8 and 9, the hull displacement pressures 62*c* and 62*d*, respectively, push generally outward on the drive in the starboard direction. The hull displacement pressure 62*a*-62*d* on each drive 6-9 is dependent on several factors, including the vessel beam, the vessel deadrise, the maximum trim angle, and the relationship between a drive mounting distance to keel and a planing chine. The hull displacement pressure 62*a*-62*d* also varies with speed of the marine vessel 2. Each of these factors affects how much of the vessel's hull is in the water, and thus the amount of water being displaced as the vessel moves and the pressure created thereby. The vessel beam is the widest point of the vessel measured at the waterline. The vessel deadrise is the angle, measured in degrees from horizontal, of the portion of the hull between the keel and the planing chine, typically at the transom 44. A chine is a sharp change in angle in the cross section of a hull, and the planing chine is the chine at the waterline when the vessel 2 is planing. Thus, the relationship between the drive mounting distance to the keel of the vessel 2 and the planing chine of the vessel 2 describes where the drive 6-9 runs in the water when the vessel 2 is planing. In other words, this drive-to-keel vs. planing chine relationship illustrates the drive to water ratio when the boat is running on its plane chine. One of ordinary skill in the art will understand that both the hull displacement pressure 62 and the propeller pressure 64 go up as the distance from the keel increases, and thus the outer drives see more pressure than the inner ones. The trim angle describes the amount of trim being applied to the marine vessel 2, and may describe the angle of the drive with respect to the transom 44, or the angle of trim tabs extending from the stern 3 of the vessel 2. The trim angle is typically adjusted as the vessel 2 is underway.

The propeller pressure 64 acting on each drive 6-9 depends on the speed of the marine vessel 2, the direction of rotation of the propeller 26-29 of that drive, the height and setback of the marine drive 6-9, as well as the and relationship between the drive mounting distance to the keel and a planing chine. The drive height describes the distance of the base portion of the marine drive, such as the skeg and gearcase, with respect to the running surface of the marine vessel 2 directly in front of the marine drive 6-9. The drive setback describes the distance of the marine drive 6-9 from the transom 44. As described above, the marine drives 6-9 are preferably arranged with each set comprising counter rotating propellers. This allows the propeller pressures between the drives in a set to counteract one another. In the depicted embodiment, the outer port propeller 26 rotates in a counter-clockwise direction, which creates a propeller pressure 64*a* in the port direction. The propeller 27 on the inner port drive 7 rotates in the clockwise direction, resulting in propeller pressure 64*b* in the starboard direction. Likewise, propeller 28 of the starboard inner drive 8 rotates in the counter-clockwise direction, creating propeller pressure 64*c* in the port direction, and propeller 29 of starboard outer drive 9 rotates in the clockwise direction, resulting in propeller pressure 64*d* in the starboard direction.

The pressures on the marine drives also vary with their steering positions, and must be counteracted in some way in order to manipulate and control the position of the marine drives 6-9 in order to steer the marine vessel 2. As the hydrodynamic pressures on the drives generally increase with speed, the amount of counteracting force required at high vessel speeds is much greater than at low vessel speeds. One way to counteract the forces is to mechanically tie, or link, each set of drives together to balance the opposing propeller pressures 64*a* and 64*b*, 64*c* and 64*d*. FIG. 3B demonstrates that concept, where the mechanical links 51-52 balance some of the pressures on the marine drives 6-9 by providing counteracting forces 68*a*, 68*b*, 68*c*, and 68*d*.

Toe angle can also be used to counteract the forces on each set of marine drives 6 and 7, 8 and 9, and the corresponding pressure on the steering actuators 51, 52. The greater the magnitude of the unbalanced hull displacement pressures 62 and propeller pressures 64, the greater the toe angle needed to create counteracting toe pressure. FIG. 3B schematically depicts a scenario where toe forces 66*a* and 66*d* act on each set of marine drives 6 and 7, 8 and 9. Specifically, the outer port drive 6 is toed-in at angle θ creating toe pressure 66*a* on the drive 6 in the starboard direction. As the port set of marine drives 6 and 7 are linked together with mechanical link 51, the toe pressure 66*a* is distributed over both drives and relieves overall pressure required by the actuator 12 for the port set. Likewise, the starboard outer drive 9 may be toed-in at angle θ to create toe pressure 66*d* on the outer drive 9 to relieve pressure on the steering actuator 13. In the configuration of FIG. 3B, the inner marine drives 7, 8 are in the parallel position and are thus not encountering toe pressure. However, the inner marine drives 7 and 8 could also be toed inward (such as the configuration depicted in FIG. 2C) or toed outward (such as the configuration depicted in FIG. 2E), in which case toe pressures would also be applied to the inner marine drives 7 and 8. In that scenario, the toe pressures on the inner marine drives 7 and 8 seen by the steering actuators 12, 13 would be additive to the toe pressures 66*a*, 66*d* on the outer marine drives 6, 9. One of skill in the art will understand that if the marine drives were toed in the opposite direction than that depicted in FIG. 3B, toed out, the toe pressure exerted on the marine drives 6-9 would be opposite that depicted in FIG. 3B.

In one embodiment, the link toe angle θ may be calculated based on a pressure reduction amount needed on the steering actuator 12, 13. For example, the pressure reduction amount may be determined based on the maximum pressure expected on the steering actuator 12, 13, given the geometry and max speed of the boat, and the maximum output pressure available from the steering actuator 12, 13. For purposes of these calculations, it may be assumed that the pressures on the set of marine drives on either side of the centerline 10 are equal. Thus, in the depicted embodiment, each of the outer drives 6, 9 is assumed to experience the same pressure magnitude, albeit in opposite directions, and each of the inner marine drives 7, 8 is assumed to experience the same pressure magnitudes in opposite directions. Thus, the hull displacement pressure 62 and the propeller pressure 64 may be derived for each inner drive 7, 8 and each outer drive 6, 9.

In one embodiment, the hull displacement pressure and the propeller pressure on each of the inner drives 7, 8 and outer drives 6, 9 are determined as a function of speed. In general, one of skill in the art will understand that the maximum pressure on each drive 6-9 is not necessarily at the maximum speed of the vessel 2. In general, hull displacement pressure tends to decrease as a vessel 2 approaches its maximum speed, while the propeller pressure 64 tends to increase with speed. The propeller pressure and the hull displacement pressure may be summed to derive the pressure on each of the inner drives 7, 8 and outer drives 6, 9, as depicted in FIG. 3A for example, to determine the total pressure on the inner drives 7, 8 and the outer drives 6, 9 at a range of vessel speeds. Based thereon, a maximum required actuator pressure can be determined, which is the actuator pressure required to counteract the maximum collective pressure from the outer drives 6, 9 and the inner drives 7, 8 in the set. In one embodiment, it may be assumed that the inner drives 7, 8 and the outer drives 6, 9 see a maximum pressure at the same vessel speed, in which case the maximum required actuator pressure may be calculated as the maximum outer drive pressure (which is the maximum pressure placed on the steering actuator from the outer drive) plus the maximum inner drive pressure (which is the maximum pressure placed on the steering actuator from the inner drive).

Each steering actuator 12, 13 has a maximum amount of pressure that it can provide to steer the set of marine drives 6 and 7, 8 and 9. This is the maximum available actuator pressure. A pressure reduction amount is determined based on the maximum available actuator pressure and the maximum required actuator pressure. The pressure reduction amount is the amount of pressure that needs to be relieved from the steering system so that the steering actuators 12, 13 can function properly and carry out steering commands. At a minimum, the pressure reduction amount is the amount of pressure relief needed to bring the maximum required pressure below the maximum available actuator pressure. Accordingly, the pressure reduction amount is at least equal to the maximum required actuator pressure minus the maximum available actuator pressure for each steering actuator 12, 13. In one embodiment, the pressure reduction amount is sufficiently large to bring the maximum required actuator pressure well below the maximum available actuator pressure, thereby leaving room for the steering actuator 12, 13 to be able to steer the set of marine drives into any position at any speed and under any conditions.

A link toe angle θ is then calculated based on the pressure reduction amount. In one embodiment, a maximum outer toe angle and a maximum inner toe angle are calculated to achieve a total toe pressure equal to the pressure reduction amount. Preferably, each of the maximum inner toe angle and the maximum outer toe angle are between −3° and 3°. The link toe angle θ may then be calculated on the maximum inner and outer toe angles. In one embodiment, the link toe angle θ is calculated according to the following equation:

$$\theta=(\text{max outer toe angle}-\text{max inner toe angle})/2$$

The set of marine drives is then connected together to achieve the link toe angle. As depicted in FIG. 2B, this can be achieved by rotating each outer marine drive 6, 9 to a positive toe angle equal to the link toe angle θ. Alternatively, both of the drives in the set can be rotated such that their foremost ends are turned toward one another (a relative toe-in position for the set) such that the toe angle of the inner marine drive 7, 8 plus the toe angle of the outer marine drive 6, 9 (where both toe angles are considered positives) equal the link toe angle θ. The mechanical link 51, 52 maintains the relative angle between the drives in each set 6 and 7, 8 and 9 at the link toe angle θ.

Each set of marine drives 6 and 7, 8 and 9 are then separately steerable, as described above. While in joysticking mode, it may be desirable to steer each set 6 and 7, 8 and 9 separately to different steering angles. However, when traveling straight ahead towards at high speeds and/or under high steering loads, it is desirable to rotate the sets 6 and 7, 8 and 9 in equal and opposite directions so that any lateral propulsion forces created by the drives are counteracted. At high speeds and/or high steering loads, the sets of marine drives 6 and 7, 8 and 9 may be positioned by the respective steering actuators 12, 13 in a positive toe, or "toe-in" position. FIG. 2C depicts an embodiment where the steering actuators 12, 13 have positioned each set of marine drives 6 and 7, 8 and 9 to actuator toe angle Φ. Accordingly, each inner marine drive 7, 8 is positioned at toe angle Φ, and each outer marine drive 6, 9 is positioned at toe angle Φ+θ. Likewise, the sets of marine drives 6 and 7, 8 and 9 may be positioned by the respective steering actuators 12, 13 in a negative toe, or "toe-out" position. FIG. 2E depicts an embodiment where the steering actuators 12, 13 have positioned each set of marine drives 6 and 7, 8 and 9 to actuator toe angle −Φ. Accordingly, each inner marine drive 7, 8 is positioned at toe angle −Φ, and each outer marine drive 6, 9 is positioned at toe angle −Φ+−θ. In one embodiment, the actuator toe angle Φ is determined by accessing a value in a toe angle lookup table based on the speed of the vessel. The toe angle lookup table is, for example, a table of angle values for the range of speeds that could be traveled by a particular marine vessel 2, wherein each angle value is calculated to produce a particular collective toe pressure on the sets of drives 6 and 7, 8 and 9 needed to counteract the hull displacement pressures and propeller pressures at that speed.

Figure 4:
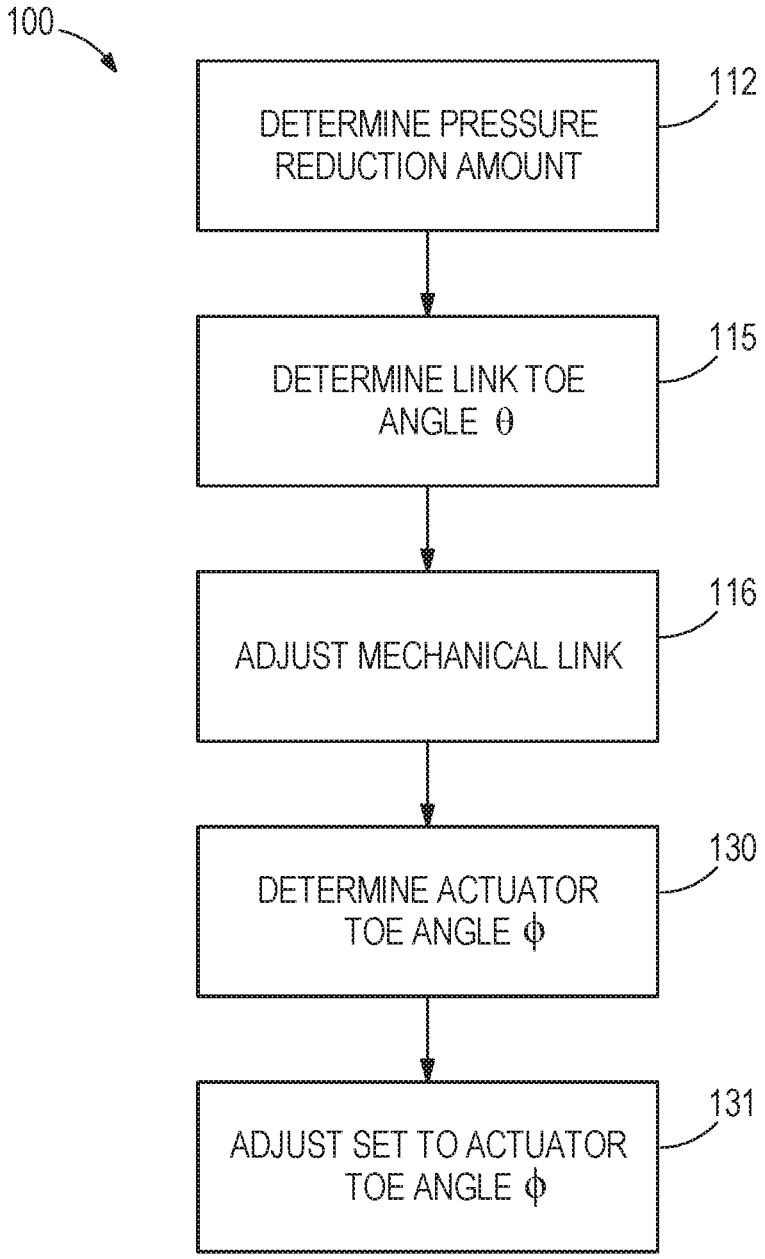
FIG. 4 illustrates one example of a method of controlling steering loads on a marine propulsion system of a marine vessel.

FIG. 4 depicts one embodiment of a method 100 of controlling steering loads on a marine propulsion system 1. At step 110, a maximum required actuator pressure is determined. Based thereon, a link toe angle θ is determined at step 115. At step 116, the mechanical link of each set of drive is adjusted to achieve the link toe angle. At step 130, an actuator toe angle is determined based on a speed of the marine vessel. The toe angle of each set of marine drives is then adjusted with the respective steering actuator by the actuator toe angle Φ.

Figure 5:
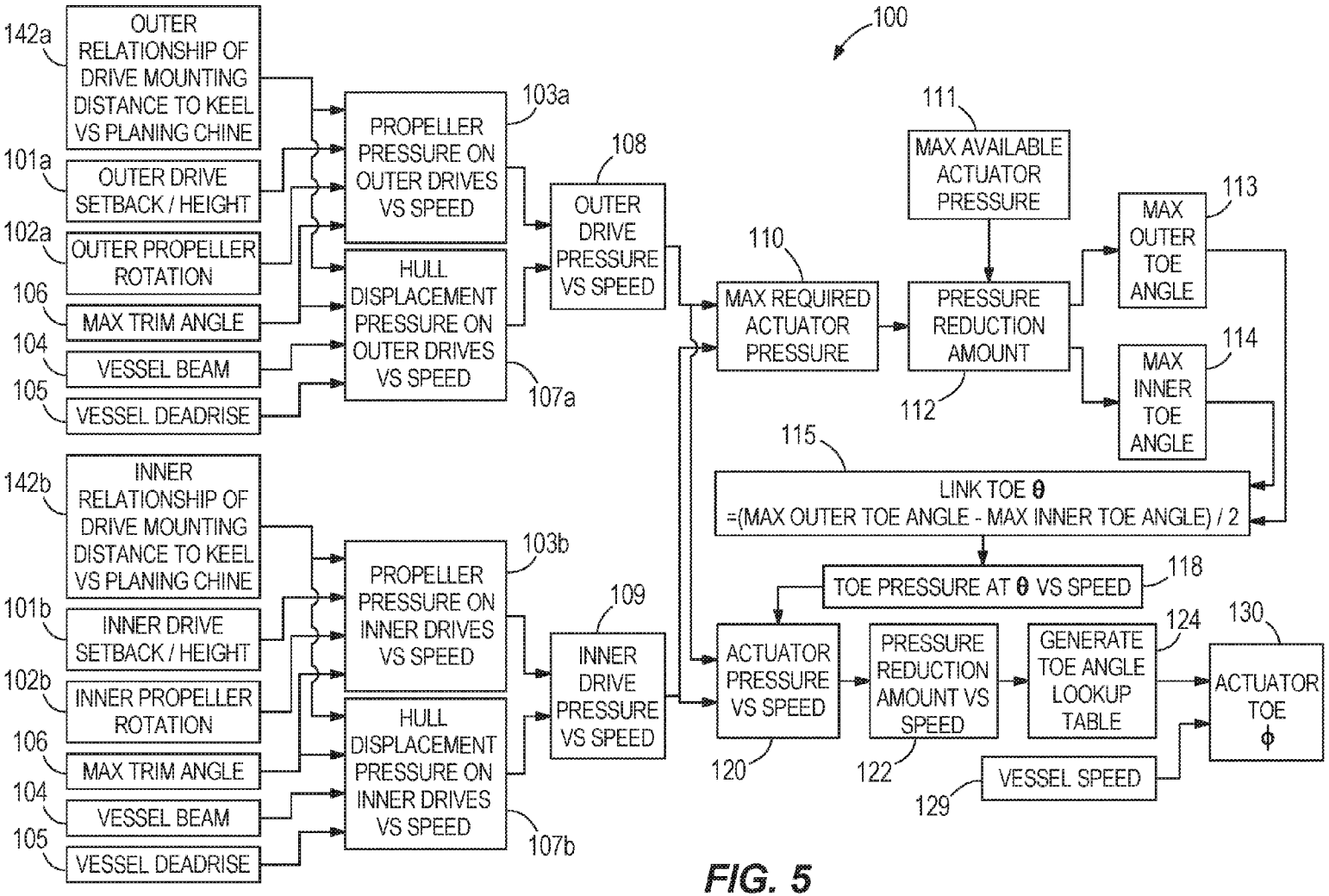
FIG. 5 illustrates another example of a method of controlling steering loads on a marine propulsion system of a marine vessel.

FIG. 5 depicts another embodiment of a method 100 of controlling steering loads. At steps 101*a* and 101*b*, the pressure on each outer marine drive (step 101*a*) and each inner marine drive (step 101*b*) a result of the position of the marine drive with respect to the stern 3, including the drive setback and drive height, is determined at various speeds. At steps 102*a* and 102*b*, a pressure on each outer drive (step 102*a*) and each inner drive (step 102*b*) due to the propeller rotation is determined at various speeds. Further, at step 142*a* the pressure on each outer marine drive due to the relationship of the drive mounting distance to the keel versus the planing chine is determined; and at step 142*b* the pressure on each inner marine drive due to the relationship of the drive mounting distance to the keel versus the planing chine is determined. Based on the results of those steps 101*a* and 101*b*, 102*a* and 102*b*, 142*a* and 142*b*, the propeller pressure on the outer marine drive at various speeds is then determined at step 103*a*, and the propeller pressure on the inner marine drive at various speeds is determined at step 103*b*. The hull displacement pressure on each of the outer drives at various speeds is calculated at step 107*a* based on the vessel beam 104, the vessel deadrise 105, and the maximum trim angle 106. The same is done for the inner drives at step 107*b*. The pressure on each outer drive at various speeds is then calculated at step 108 based on the propeller pressure and the hull displacement pressure on the outer drives at those various speeds. Likewise, the pressure on each inner drive at those various speeds is calculated at step 109 based on the propeller pressure and the hull displacement pressure on the inner drives at those speeds.

At step 110, the maximum required actuator pressure is calculated based on the inner drive pressure and the outer drive pressure. The maximum required actuator pressure 110 can be determined, for example, as the pressure at the speed where the outer drive pressure plus the inner drive pressure reaches a maximum. The maximum available pressure for each steering actuator is determined at step 111. A pressure reduction amount for each steering actuator is then determined at step 112 based on the maximum required actuator pressures and the maximum available actuator pressures. A maximum outer toe angle is then determined at step 113, and a maximum inner toe angle is determined at step 114, wherein the maximum outer and inner toe angles are calculated to produce the pressure reduction amount. The link toe angle θ is then calculated at step 115 as the maximum outer toe angle minus the maximum inner toe angle divided by two. The marine drives can then be mechanically linked to achieve the toe angle, as is described above.

At step 118, the toe pressure when the marine drives are at the link toe angle θ is determined at various speeds. At step 120, the pressure on the actuator due to the set of marine drives positioned at the link toe angle θ is then calculated at the various speeds. In an exemplary embodiment, the actuator pressure from the set of marine engines positioned at the link toe position θ can be calculated as the sum of the outer drive pressure, inner drive pressure, and toe pressure at various speeds, such as by summing the forces as illustrated in FIG. 3B. The pressure reduction amount is then calculated at the various speeds at step 122. A toe angle lookup table is then generated at step 124 containing the actuator toe angles 1 that produce the pressure reduction amounts at the various speeds. Based on the toe angle lookup table and the vessel speed determined at step 129, the actuator toe angle is determined at step 130. The steering actuators can then be operated to rotate the sets of marine drives to the actuator toe angle. The actuator toe angle may be continuously adjusted as the vessel speed changes. Additionally, the actuator toe angle may be further adjusted based on pressures in the steering actuators, such as is described in application Ser. No. 14/843,439, filed Sep. 2, 2015 incorporated by reference and described herein above.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A method of controlling steering loads on a marine propulsion system of a marine vessel having at least two sets of marine drives, each set having at least an inner marine drive and an outer marine drive, and a steer-by-wire steering actuator associated with each set of marine drives, the method comprising:

determining a maximum required actuator pressure on each steer-by-wire steering actuator;

determining a pressure reduction amount based on the maximum required actuator pressure;

determining a link toe angle based on the pressure reduction amount; and adjusting a mechanical link connecting each inner marine drive to the respective outer marine drive to achieve the link toe angle.

2. The method of claim 1, further comprising:

determining an actuator toe angle based on a speed of the marine vessel; and adjusting each set of marine drives with the steer-by-wire steering actuator by the actuator toe angle.

3. The method of claim 1, further comprising determining a maximum inner drive pressure on each steer-by-wire steering actuator due to each inner marine drive and a maximum outer drive pressure on each steer-by-wire steering actuator due to each outer marine drive.

4. The method of claim 3, wherein the maximum required actuator pressure on the steer-by-wire steering actuator is the maximum inner drive pressure summed with the maximum outer drive pressure.

5. The method of claim 4, wherein the pressure reduction is greater than or equal to the maximum required actuator pressure of each steer-by-wire steering actuator minus a maximum available actuator pressure of that steer-by-wire steering actuator.

6. The method of claim 4, wherein the maximum inner drive pressure for each inner marine drive and the maximum outer drive pressure for each outer marine drive is determined based on a hull displacement pressure on that marine drive and a propeller pressure on that marine drive.

7. The method of claim 6, wherein the hull displacement pressure is determined based on at least one of a vessel deadrise, a vessel beam, a maximum trim angle, and a relationship between a drive mounting distance to keel and a planing chine.

8. The method of claim 7, wherein the propeller pressure for each inner drive and each outer drive is determined based on at least one of a drive height, a drive setback, a direction of propeller rotation, and a relationship between a drive mounting distance to keel and a planing chine.

9. The method of claim 1, further comprising determining a maximum inner toe angle for each inner marine drive and a maximum outer toe angle for each outer marine drive based on the pressure reduction amount, wherein the link toe angle is calculated based on the maximum inner toe angle and the maximum outer toe angle.

10. The method of claim 9, wherein the link toe angle equals the maximum outer toe angle minus the maximum inner toe angle, divided by 2.

11. The method of claim 9, wherein the link toe angle is achieved when the outer marine drive is at the link toe angle and the inner marine drive is in a parallel position.

12. The method of claim 2, wherein the actuator toe angle is determined by accessing a value in a toe angle lookup table based on the speed of the vessel.

13. The method of claim 12, wherein the value in the toe angle lookup table is determined based on the link toe angle and at least one of a hull displacement pressure and a propeller pressure on each steer-by-wire steering actuator from each inner marine drive and each outer marine drive.

14. A marine propulsion system comprising:

at least two sets of marine drives, each set of marine drives having at least an inner marine drive and an outer marine drive;

a mechanical link connecting each inner marine drive to the respective outer marine drive to achieve a link toe angle;

a steer-by-wire steering actuator associated with each set of marine drives; and a steering controller associated with each steering actuator;

wherein each steering controller determines an actuator toe angle based on the speed of the vessel to minimize the work of the associated steer-by-wire steering actuator and controls that steer-by-wire steering actuator to rotate the associated set of marine drives by the actuator toe angle.

15. The system of claim 14, wherein the link toe angle is calculated based on a pressure reduction amount determined for each steer-by-wire steering actuator.

16. The system of claim 15, wherein the pressure reduction amount is determined based on a maximum available actuator pressure of each steer-by-wire steering actuator and the maximum required actuator pressure.

17. The system of claim 14, wherein the link toe angle is calculated based on a maximum inner toe angle for the inner marine drive and a maximum outer toe angle for the outer marine drive to achieve the pressure reduction amount.

18. The method of claim 17, wherein the link toe angle equals the maximum required outer toe angle minus the maximum required inner toe angle, divided by 2.

19. The system of claim 14, wherein the actuator toe angle is determined by accessing a value in a toe angle lookup table based on the speed of the vessel.

20. The system of claim 19, wherein the value in the toe angle lookup table is determined based on the link toe angle and at least one of a hull displacement pressure and a propeller pressure on each steer-by-wire steering actuator.

* * * * *